US008763851B2

(12) United States Patent
Jiang et al.

(10) Patent No.: US 8,763,851 B2
(45) Date of Patent: Jul. 1, 2014

(54) DOOR ASSEMBLY FOR ICE STORAGE BIN

(75) Inventors: Weiwei Allen Jiang, Zhejiang (CN); Yong Terry Wang, Zhejiang (CN)

(73) Assignee: Manitowoc Foodservice Companies, LLC, Manitowoc, WI (US)

( * ) Notice: Subject to any disclaimer, the term of this patent is extended or adjusted under 35 U.S.C. 154(b) by 50 days.

(21) Appl. No.: 13/197,454

(22) Filed: Aug. 3, 2011

(65) Prior Publication Data

US 2012/0031007 A1 Feb. 9, 2012

Related U.S. Application Data

(60) Provisional application No. 61/370,789, filed on Aug. 4, 2010.

(51) Int. Cl.
*B65D 43/16* (2006.01)

(52) U.S. Cl.
USPC ..... 220/832; 220/831; 220/326; 16/319; 16/334; 16/342; 16/337

(58) Field of Classification Search
USPC ..... 16/49, 319, 334, 342, 337; 220/831, 220/832, 326
See application file for complete search history.

(56) References Cited

U.S. PATENT DOCUMENTS

| | | | | |
|---|---|---|---|---|
| 203,870 | A | 5/1878 | Anderson | |
| 6,913,125 | B2 * | 7/2005 | Hayashi | 188/290 |
| 2003/0126717 | A1 * | 7/2003 | Iwashita | 16/82 |
| 2004/0035137 | A1 | 2/2004 | Kuroyanagi et al. | |
| 2005/0193523 | A1 | 9/2005 | Nam et al. | |
| 2009/0000061 | A1 * | 1/2009 | Lin et al. | 16/319 |

FOREIGN PATENT DOCUMENTS

JP 3170760 B2 5/2001

OTHER PUBLICATIONS

Manitowoc "Ice Storage Bins" Specification Sheet, consisting of 2 pages, Jan. 2010.

International Search Report and Written Opinion dated Jan. 5, 2012 for corresponding International Patent Application No. PCT/US2011/046427.

English translation of First Office Action issued by the State Intellectual Property Office (SIPO) of the People's Republic of China issued on Jul. 2, 2013 for corresponding Chinese patent Application No. 201110082482.6, pp. 11.

Notification of Transmittal of International Preliminary Report on Patentability (Chapter II of the Patent Cooperation Treaty) dated Feb. 28, 2013 for corresponding International Patent Application No. PCT/US2011/046427 consisting of 11 pages.

Notification Concerning Transmittal of International Preliminary Report on Patentability (Chapter I of the Patent Cooperation Treaty) dated Feb. 14, 2013 for corresponding International Patent Application No. PCT/US2011/046427 consisting of 7 pages.

* cited by examiner

*Primary Examiner* — Anthony Stashick
*Assistant Examiner* — Blaine Neway
(74) *Attorney, Agent, or Firm* — Ohlandt, Greeley, Ruggiero & Perle, L.L.P.

(57) ABSTRACT

A door assembly is provided that includes a door, a hinge portion, a locking member and a damper member. The locking member locks the door in an opened position and the damper member provides resistance as the door moves from the opened position to the closed position.

12 Claims, 8 Drawing Sheets

DOOR ASSEMBLY FOR ICE STORAGE BIN

CROSS REFERENCE TO RELATED PATENT APPLICATIONS

This application claims the benefit of U.S. Provisional Application No. 61/370,789, filed Aug. 4, 2010. U.S. Provisional Application No. 61/370,789, filed Aug. 4, 2010 is hereby incorporated herein by reference in its entirety.

BACKGROUND

1. Field of the Disclosure

The present disclosure relates to a door assembly having both a locking member and a damper member. More particularly, the present disclosure relates a door of an ice storage where the locking member allows a door to remain in a locked open position during use and the damper member enables the door to be smoothly closed without impact.

2. Description of Related Art

Conventional ice storage bins of an ice making machine often include a door having a simple door pin that cannot lock the door while in an open position. Instead, a person opening the ice storage bin door must hold the door open by hand when taking ice from the bin.

Furthermore, when a person allows the storage bin door to freely close by gravity, it can often create a large impact on the door and the bin. This can cause a loud noise and possibly damage the ice storage bin or the door itself.

Thus, there is a need for an ice storage bin door that incorporates both a means to lock the door in its open position and a damper to provide a reduction in impact when closing the door.

SUMMARY

The present disclosure provides for a door assembly including a door, a locking member for holding the door in an open position and a damper member for allowing the door to close smoothly and with reduced impact. It is preferred that the locking member and the damper member are disposed on opposite ends of the door.

Furthermore, the locking member includes a sleeve and a pivot there within for locking and the damper member includes a damper allowing the door to close in a sub-horizontal position.

BRIEF DESCRIPTION OF THE DRAWINGS

Other and further benefits, advantages and features of the present invention will be understood by reference to the following specification in conjunction with the accompanying drawings, in which like reference characters denote like elements of structure and.

DETAILED DESCRIPTION OF THE PREFERRED EMBODIMENT

Figure 1:
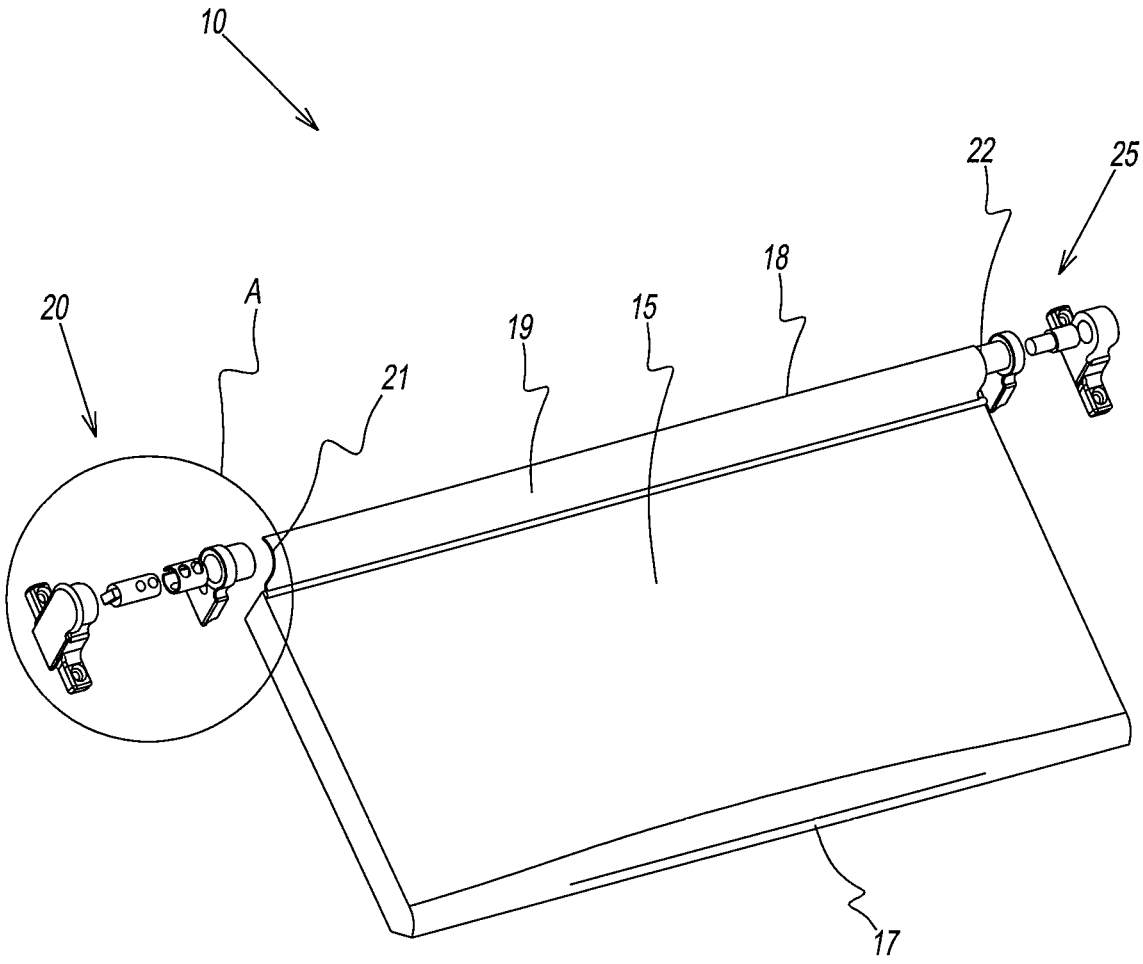
FIG. 1 is a first perspective view of a door assembly of the present disclosure.
Figure 2:
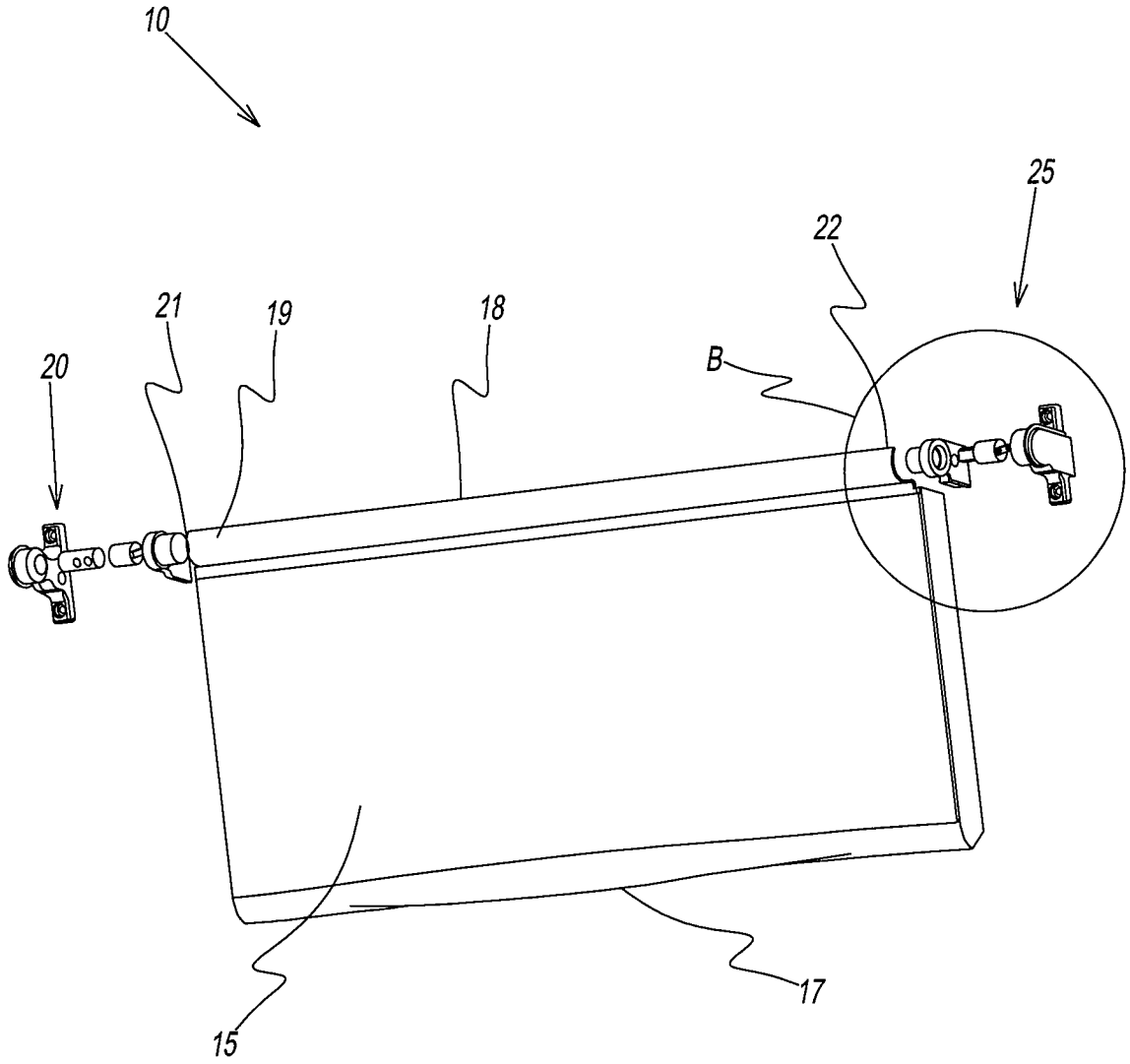
FIG. 2 is second perspective view of the door assembly shown in FIG. 1.
Figure 3:
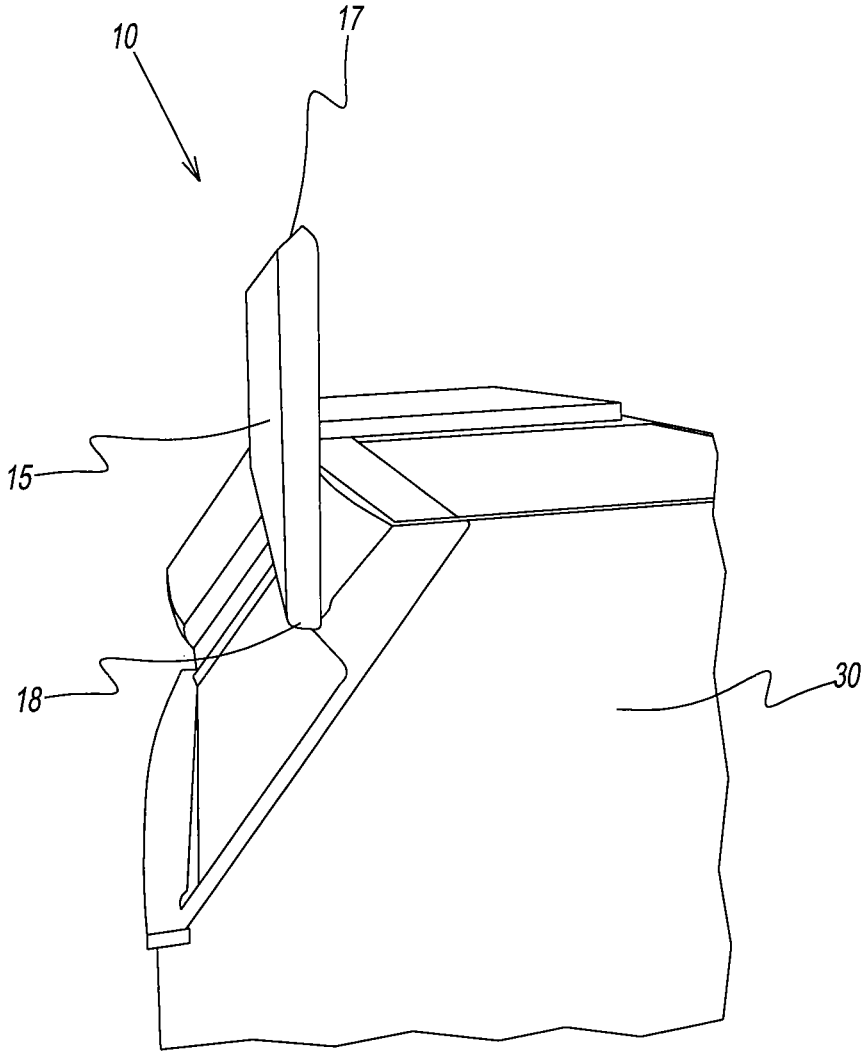
FIG. 3 is a side view of a door assembly of the present disclosure.

Referring to FIGS. 1 and 2, there is shown a door assembly 10 according to the present disclosure. Door assembly 10 includes a door 15 with a locking member 20 and a damper member 25 attached thereto. It is preferred that locking member 20 and damper member 25 are oppositely disposed on the door. As shown in FIG. 3 door assembly 10 may be connected to a bin 30. Bin 30 can be any storage-type bin, such as but not limited to an ice storage bin of an ice making machine.

Door 15 is a conventional door used on storage bin-type equipment. Preferably, door 15 used with an ice storage bin is a hollow structure having a foam material within to promote thermal resistance. Furthermore, door 15 may be weighted to facilitate closing. In the preferred embodiment of an ice storage bin, door 15 is utilized by a user to access the ice within. Generally, door 15 can have first end 17 where the user grips the door and a second end 18 to towards bin 30. As shown in FIGS. 1 and 2, it is preferred that second end 18 has a hinge portion 19. Hinge portion 19 has a first hinge end 21 and a second hinge end 22.

Figure 4:
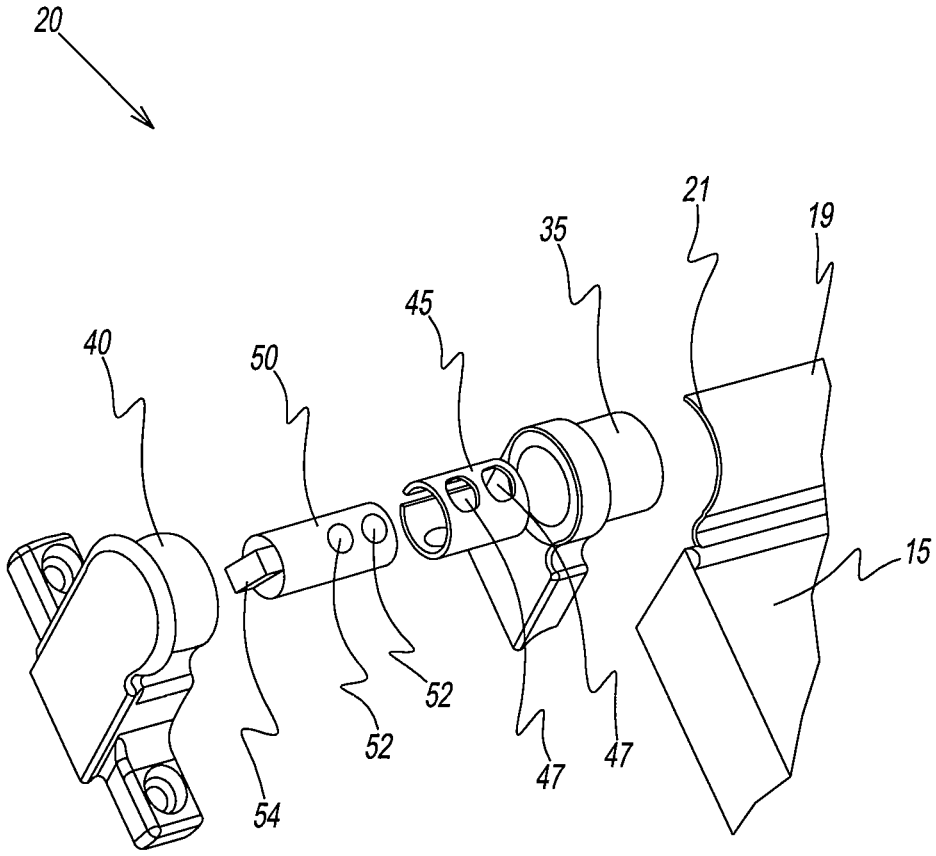
FIG. 4 is an enlarged view of area A of FIG. 1, showing an exploded view of a locking member of the door assembly.

FIG. 4 is an enlarged view of area A of FIG. 1, showing the details of locking member 20. Locking member 20 allows a user to lock door 15 in an open position. Preferably, door 15 is locked in a vertical open position. Thus, the user does not need to hold the door open by hand when removing items from bin 30, such as ice. As a result, locking member 20 may prevent door 15 from impacting and damaging bin 30. Door assembly 10 may require a single locking member 20. To achieve this, door 15 should be of a suitable weight to allow a single locking member 20 hold door 15 in a locked open position.

Locking member 20 includes a locking bracket 40, a locking cover 35, a sleeve 45 and a pivot 50. Locking bracket 40 connects to bin 30 by any conventional method such as, but not limited to, screws, clips bolts and nails. Locking cover 35 connects to second end 18 of door 15, preferably at first hinge end 21 of hinge portion 19. Locking cover 35 can connect by any conventional method, such as but not limited to screws, clips bolts and nails.

Figure 5:
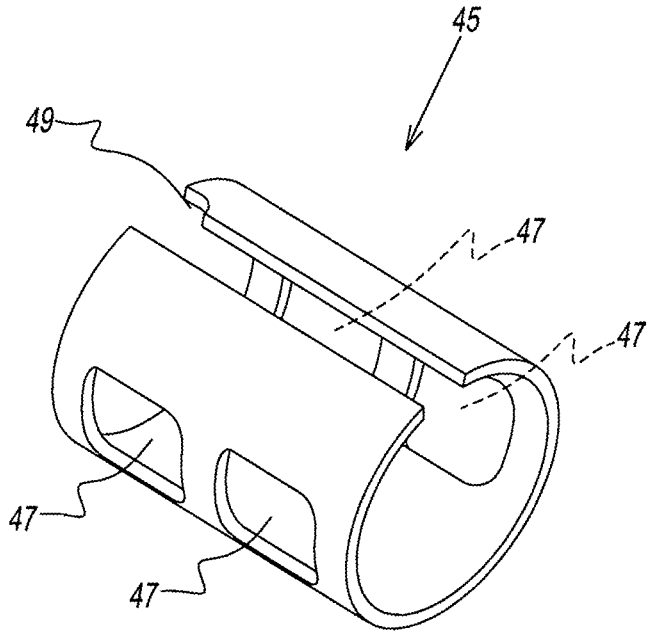
FIG. 5 is a perspective view of a sleeve of the locking member shown in FIG. 4.

Sleeve 45 is a hollow cylindrical tube having at least one aperture 47 and an opening 49. As shown in FIG. 5, it is preferred that sleeve 45 has at least two pairs of apertures 47 oppositely disposed and opening 49 therebetween. Sleeve 45 can be made of any durable material, such as, but not limited to, metal, steel, plastic, and wood. Preferably, sleeve 45 is made of spring steel. As shown in FIG. 4, sleeve 45 can be slidably disposed within locking cover 35. Preferably, opening 49 corresponds with a ridge or dowel (not shown) within locking cover 35 to secure sleeve 45 to locking cover 35. As a result, this allows sleeve 45 to rotate when a user opens or closes door 15.

Figure 6:
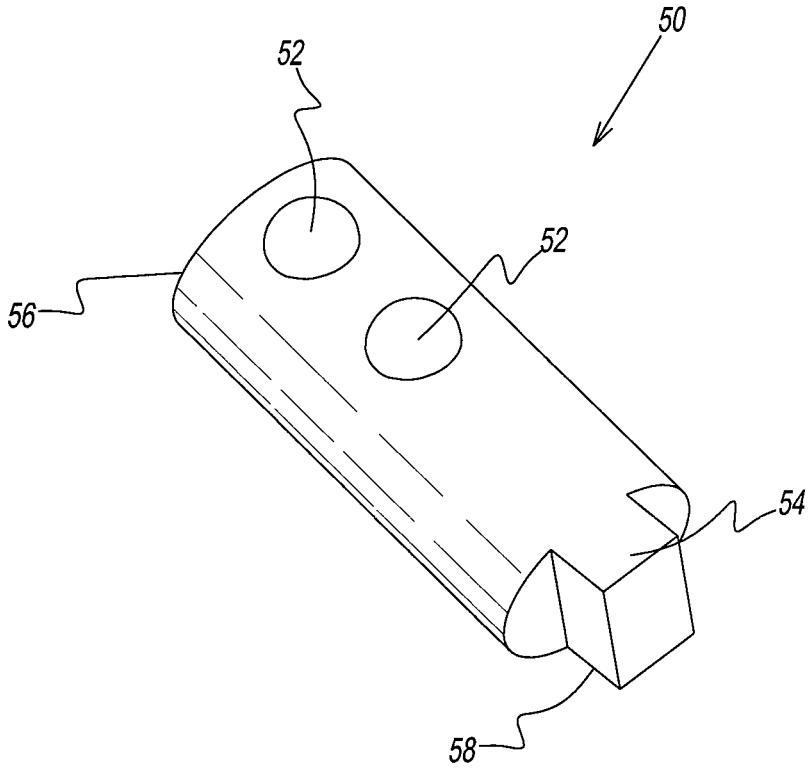
FIG. 6 is a perspective view of a pivot of the locking member shown in FIG. 4.

Pivot 50 is a cylindrical tube or rod having a first pivot end 56 and a second pivot end 58. Furthermore, pivot 50 has at least one reciprocal locking protuberance 52 disposed on its surface. As shown in FIG. 6, it is preferred that at least two spherically shaped protuberances 52 are spring actuated (not shown) about pivot 50. Pivot 50 can be made of any durable material, such as, but not limiting to, metal, steel, plastic or wood. Preferably, pivot 50 is made of cold drawn steel. It is preferred that protuberances 52 are made of steel, however they can be made of other materials such as, any metal, plastic or wood.

As shown in FIG. 4, pivot 50 is sized to be slidably disposed within sleeve 45 via first pivot end 56. When pressure is placed on protuberances 52 the springs contract to allow protuberances 52 to retract within pivot 50, into a retracted position. This provides pivot 50 with a smooth surface, allowing sleeve 45 to slide and rotate around pivot 50. Protuberances 52 on pivot 50 correspond with apertures 47 of sleeve 45, and once properly aligned, the springs expand to reset protuberances 52, to a starting position.

Pivot 50 is connected to locking bracket 40 via second pivot end 58. As shown in FIGS. 4 and 6, it is preferred that second end pivot 58 has a pivot ridge 54 to correspond with a depression (not shown) on locking bracket 40. Thus, pivot 50 and sleeve 45 are disposed between locking bracket 40 and locking cover 35.

In use, when a user lifts up door 15 at second end 17, sleeve 45 rotates with door 15 while pivot 50 remains in place. Pivot 50 does not rotate since it is connected to locking bracket 40. Thus, sleeve 45 rotates around pivot 50 when protuberances 52 are in a retracted position. When door 15 reaches a preset open position, preferably vertical, the springs expand such that protuberances 52 expand into apertures 47 of sleeve 45. This causes door 15 to remain in the locked and opened position, allowing retrieval of ice from the ice storage bin.

When user applies sufficient pressure on door 15 at second end 17, protuberances 52 are again caused to retract within pivot 50 such that sleeve 45 freely rotates about pivot 50, thereby allowing door 15 to return to the closed position via gravity.

Figure 7:
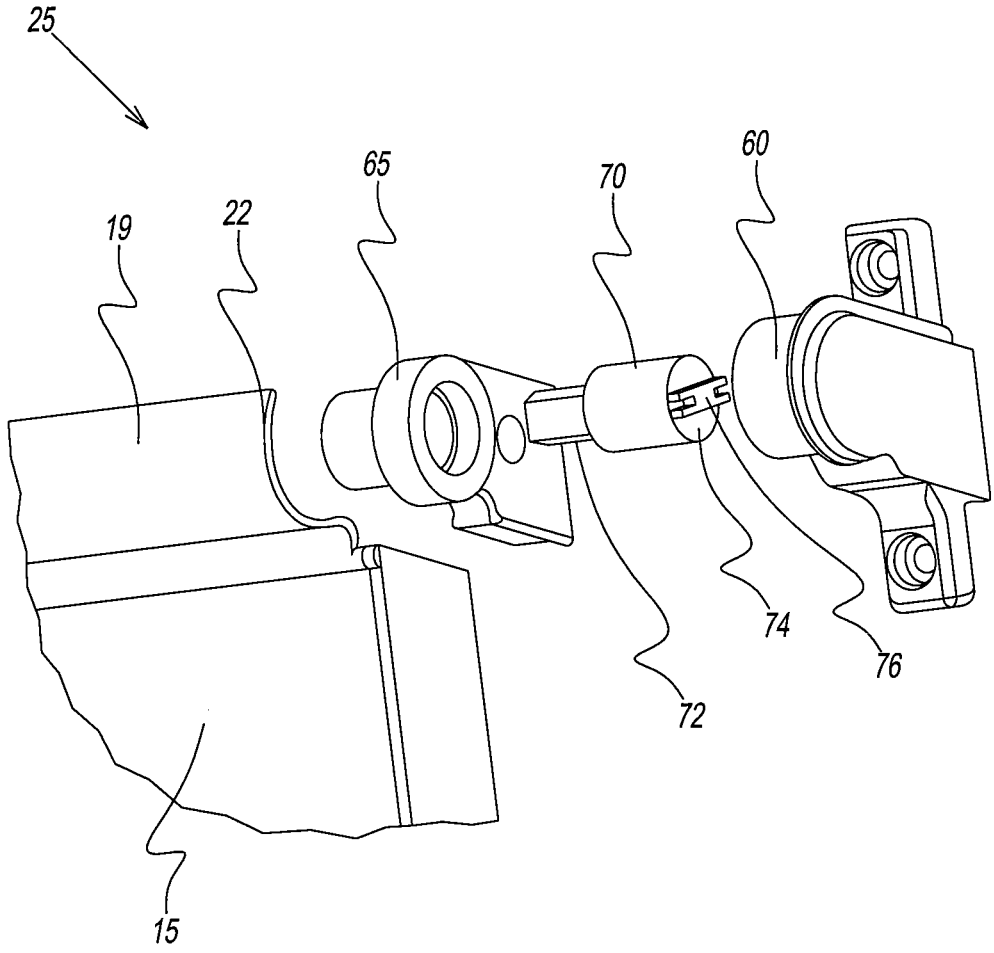
FIG. 7 is an enlarged view of area B of FIG. 2, showing an exploded view of a damper member of the door assembly.

As shown in FIGS. 1 and 2, door 15 also has a damper member 25 oppositely disposed from locking member 20 about hinge portion 19 on second end 18 of door 15. FIG. 7 is an enlarged view of area B of FIG. 2, showing the details of damper member 25. Damper member 25 allows the user to close door 15 smoothly and with reduced impact to door 15 and bin 30. In particular, damper member 25 generates resistance on door 15, thus eliminating impact against bin 30 when allowing door to freely close by gravity.

Similar to locking member 20, damper member 25 has a damper bracket 60 that connects to bin 30 and a damper cover 65 that connects to second end 18 of door 15, preferably at second hinge end 22 of hinge portion 19. As shown in FIG. 7, damper member 25 further includes a damper 70 having a first damper end 72 and a second damper end 74.

First damper end 72 may be slidably disposed within damper cover 65. Damper 70 can be connected to damper bracket 60. As shown in FIG. 7, it is preferred that second damper end 74 has a damper ridge 76 that corresponds with a depression (not shown) on damper bracket 60. Thus, damper 70 is disposed between damper bracket 60 and damper cover 65. Damper 70 can be any conventional damper providing sufficient resistance to avoid an impact of door 15 with bin 30.

Figure 8:
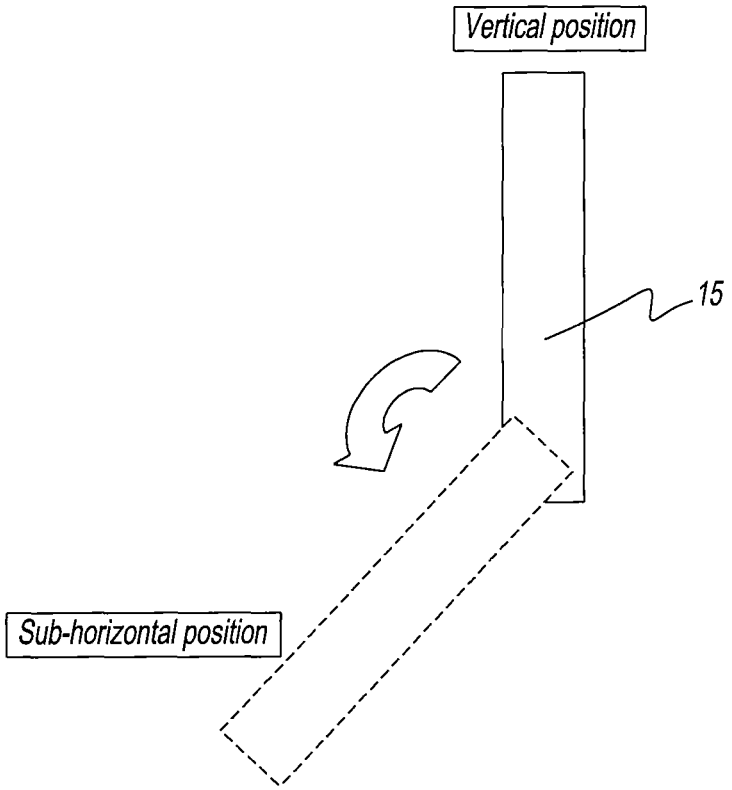
FIG. 8 is a side view of a door of the door assembly, showing the open, vertical position and the closed, sub-horizontal position.

Furthermore, it is preferred that locking member 20 and damper member 25 allow door 15 to fully open in an open vertical position and thereafter to fully close in a sub-horizontal position, as shown in FIG. 8.

What is claimed is:

1. A door assembly comprising: a door;

a hinge portion disposed on one end of said door, thereby allowing said door to move between an opened position and a closed position;

a locking member disposed on a first hinge end of said hinge portion, wherein said locking member enables said hinge portion to move from said opened position to said closed position, as well as locks said door when in said opened position, and wherein said locking member is connectable to a bin;

wherein said locking member comprises a locking bracket, a locking cover attached to said hinge portion of said door and a pivot slidably disposed within a sleeve; and a damper disposed on a second hinge end of said hinge portion, wherein said damper provides resistance as said door moves from said opened position to a said closed position;

wherein said bin is an ice storage bin of an ice making, machine.

2. The door assembly of claim 1, wherein said damper member comprises: a damper bracket, a damper cover attached to said hinge portion of said door and a damper.

3. A door assembly comprising:

a door;

a hinge portion disposed on one end of said door, thereby allowing said door to move between an opened position and a closed position;

a locking member disposed on a first hinge end of said hinge portion, wherein said locking member enables said hinge portion to move from said opened position to said closed position and locks said door when in said opened position, wherein said locking member has a locking bracket, a locking cover, a sleeve and a pivot, wherein said locking bracket is connectable to a bin and said locking cover connects to said first hinge end, and wherein when locked said door is moved from said open position by a predetermined pressure applied to said door, wherein said pivot is a tube or rod having a first pivot end, a second pivot end opposite said first pivot end, and at least one protuberance, wherein said pivot is sized to be slidably disposed within said sleeve via said first pivot end, and wherein pressure is placed on said at least one protuberance so that said at least one protuberance retracts within said pivot in a retracted position allowing said sleeve to slide and rotate around said pivot.

4. The door assembly of claim 3, wherein said sleeve is a hollow cylindrical tube having at least one aperture and an opening.

5. The door assembly of claim 4, wherein said sleeve is slidably disposed within said locking cover.

6. The door assembly of claim 5, wherein said at least one protuberance is spring actuated.

7. The door assembly of claim 6, wherein said pivot is connected to said locking bracket via said second pivot end, so that said pivot and said sleeve are disposed between said locking bracket and said locking cover.

8. The door assembly of claim 7, wherein when said pressure is placed on said at least one protuberance said spring contracts to allow said at least one protuberance to retract within said pivot in said retracted position allowing said sleeve to slide and rotate around said pivot.

9. The door assembly of claim 8, wherein said sleeve rotates with said door while said pivot remains in place.

10. The door assembly of claim 9, wherein said sleeve rotates around said pivot when said at least one protuberance is in said retracted position.

11. The door assembly of claim 10, wherein when said door reaches said open position, said spring expands such that said at least one protuberance expands into said at least one aperture of said sleeve so that said door remains locked in said opened position.

12. The door assembly of claim 11, wherein when sufficient pressure is applied on said door, said at least one protuberance is again caused to retract within said pivot such that said sleeve rotates about said pivot thereby allowing said door to return to said closed position via gravity.

* * * * *